US006378347B1

(12) United States Patent
Muse et al.

(10) Patent No.: US 6,378,347 B1
(45) Date of Patent: Apr. 30, 2002

(54) MACHINE FOR MANUFACTURING TWISTED AND OFFSET ELECTRICAL CONDUCTORS

(75) Inventors: Peter Donald Muse, Durham; Robert Bruce Wallace; Terry Michael Bowman, both of Mebane; Norman Keith Smith, Mt. Airy; Adrian Jerome Stevenson, Winston-Salem; Jerry Lee Goode, Pfafftown, all of NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/690,224

(22) Filed: Oct. 17, 2000

(51) Int. Cl.[7] ..... B21D 11/14
(52) U.S. Cl. ..... 72/299; 72/371
(58) Field of Search ..... 72/299, 295, 301, 72/371

(56) References Cited

U.S. PATENT DOCUMENTS 843,659 A * 2/1907 Baumann ..... 72/299
2,369,515 A * 2/1945 Amiot ..... 72/299
3,605,078 A * 9/1971 Paullus ..... 339/259
4,827,753 A * 5/1989 Moroney ..... 72/299
5,063,662 A * 11/1991 Porter ..... 72/299
6,260,398 B1 * 7/2001 Cisko ..... 72/299

* cited by examiner

*Primary Examiner*—Daniel C. Crane
(74) *Attorney, Agent, or Firm*—Cantor Coblurn LLP

(57) ABSTRACT

In an exemplary embodiment of the invention, a machine for shaping a bus bar comprises a first retaining device, a second retaining device, a twisting device and an offset mechanism. The first retaining device is arranged to secure a first section of the bus bar in a first plane. The second retaining device is arranged to secure a second section of the bus bar. The twisting device is connected to the second retaining device and rotates the second retaining device to twist the second section of the bus bar about a longitudinal axis of the bus bar positioning the bus bar in a second plane. The offset mechanism is connected to the first retaining device and is arranged to offset the second section of the bus bar in a third plane, the third plane generally parallel to the second plane.

22 Claims, 10 Drawing Sheets

MACHINE FOR MANUFACTURING TWISTED AND OFFSET ELECTRICAL CONDUCTORS

BACKGROUND OF THE INVENTION

The present invention relates generally to a machine for manufacturing electrical conductors and more specifically, to an apparatus for forming twisted and offset bus conductors.

Motor control centers perform various protection and control functions in industrial settings. In such motor control centers, three-phase electric power is fed from main conductors in electric power distribution mains (mains) to the motor control center. Within the motor control center housing, internal electric power is fed from the main to the motor control center electrical components through horizontal and vertical bus conductors (bus bars). Electrical power is fed through the bus conductors to internal electrical components mounted within the drawers or buckets. The buckets contain electrical components such as one or more circuit breakers, starters, overload protectors, or pilot devices.

Vertical bus conductors are arranged within the motor control center to connect the horizontal bus conductors, which are positioned in the upper section, with the buckets, which are positioned in the lower section. Conventionally, spacers are used between vertical bus conductors and horizontal bus conductors to provide protection against short circuits which may occur when there is inadequate space between the case (ie. ground), and the bus conductors or between phases. To avoid the use of spacers and promote better electrical contact with the horizontal bus conductors which are mounted planar to a back wall of the motor control center, the vertical bus conductors are twisted such that a portion of the bus conductor forms a plane perpendicular to the back wall of the motor control center and a portion is parallel to the horizontal bus conductors. In this way, spacing between the vertical bus conductors is increased. In addition, the connection between the buckets and the bus conductors can be accomplished using clips which slidably accept the bus conductors. As a result of using such clips, the bus conductors can be slidably inserted into and removed from the motor control center. To implement the turn in the bus conductors, L-shaped brackets and similar bolted connections have been used. However, the use of brackets increases the number of bolted connections utilized. Increases in the number of bolted connections leads to higher parts cost and labor for construction and maintenance and higher electrical resistance at the bolted connections.

Typically, bus conductors have been manufactured with a twist using a conventional die and a press. However, when subjecting the twisted bus conductor to a second forming operation using a second die and second press, reproducibility is made difficult. Also, adding the second forming operation significantly increases the part production cost as well as the labor cost.

BRIEF SUMMARY OF THE INVENTION

The above discussed and other drawbacks and deficiencies are overcome or alleviated by the present invention.

In an exemplary embodiment of the invention, a machine for shaping a bus bar comprises a first retaining device, a second retaining device, a twisting device and an offset mechanism. The first retaining device is arranged to secure a first section of the bus bar in a first plane. The second retaining device is arranged to secure a second section of the bus bar. The twisting device is connected to the second retaining device and rotates the second retaining device to twist the second section of the bus bar about a longitudinal axis of the bus bar positioning the bus bar in a second plane. The offset mechanism is connected to the first retaining device and is arranged to offset the second section of the bus bar in a third plane, the third plane generally parallel to the second plane.

BRIEF DESCRIPTION OF THE DRAWINGS

The present invention will now be described, by way of example, with reference to the following FIGURES, in which.

DETAILED DESCRIPTION OF THE INVENTION

Figure 1:
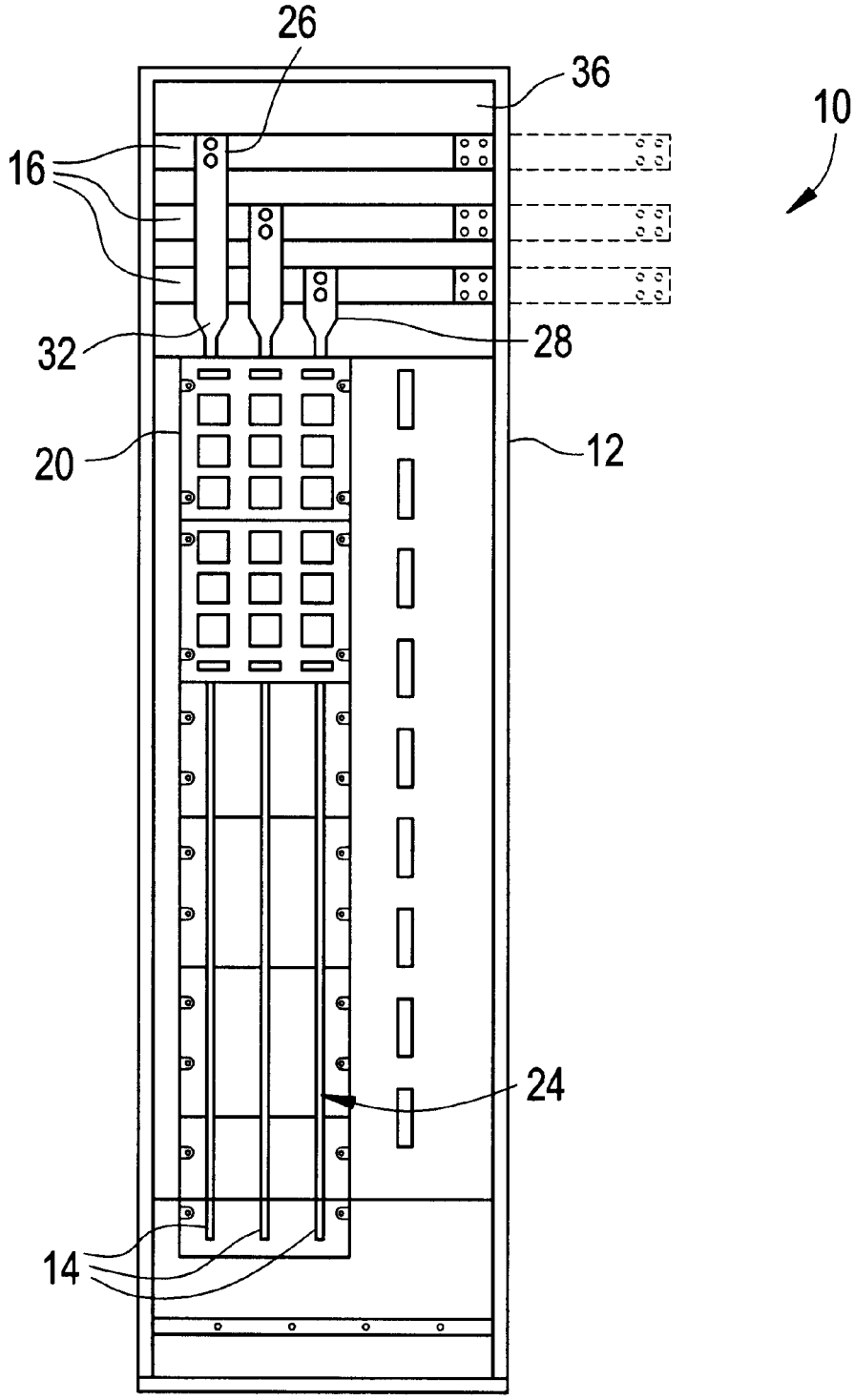
FIG. 1 is a front plan cut away view of a motor control center employing a twisted bus bar.

Referring to FIG. 1, a motor control center 10 is illustrated. The motor control center 10 consists of a metal enclosure cabinet (cabinet) 12 including a front wall 36. The front wall 36 of cabinet 12 includes buckets (not shown) which house various internal electrical devices or components such as one or more circuit breakers, starters, overload protectors, or pilot devices. The devices are electrically connected with horizontal main bus conductors via intermediate vertical bus conductors.

The motor control center 10 generally provides control and communication between the incoming power supply and an external electrical requirement, such as a motor. Sections within a motor control center 10 are designed with horizontal bus conductors (bus bars) shown at 16 and vertical bus conductors (bus bars) shown at 14. The vertical and horizontal bus bars 14, 16 carry electrical current to plug-in units that operate motors in factories. While a three phase bus bar system is shown, the bus bars manufactured according to the present invention are not limited to this configuration but may be applied to other configurations, such as one, two or four phase bus bar assemblies. It is noted that there are vertical and horizontal bus bars 14, 16 for all three phases. The vertical bus bars 14 are shown in the cutaway view of FIG. 1. The electric power is fed from the main to the internal electrical components through the horizontal bus bars 16 and the vertical bus bars 14. The vertical bus bars 14 connect the horizontal bus bars 16 to the internal electrical components housed within the motor control center 10. A ground bus bar (not shown) generally provides a common ground connection for buckets. Motor control center 10 generally provides control and communication between internal electrical components and the external electrical distribution system, including corresponding electrical motors via a control unit (not shown).

Bus covers (covers) 20 are used for insulating and separating the vertical bus bars 14. Above the covers 20, the wider profile 28, or width of the vertical bus bars 14, is used for connection to the flat horizontal bus bars 16 at connecting sections generally shown at 26. The vertical bus bars 14 have a twist, preferably about a ninety-degree twist, as shown at 32 about the centerline of each bus bar 14. The vertical bus bars 14 pass through the cavities (not shown) that are formed within the covers 20. The vertical bus bars 14 have a slim profile while passing through the covers 20 as shown at 24.

Figure 2:
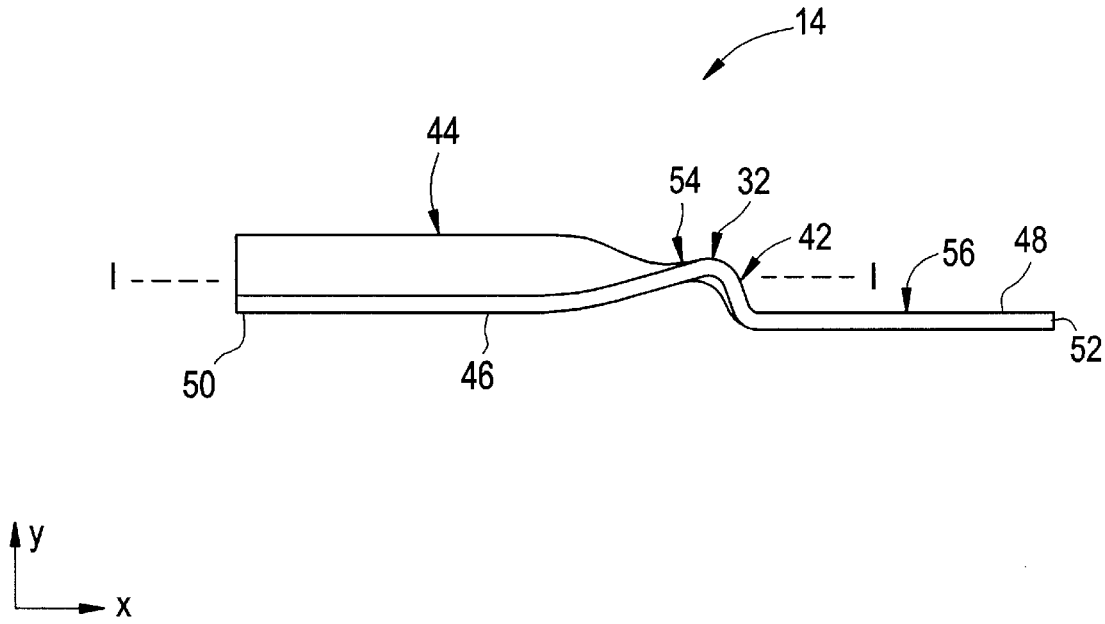
FIG. 2 is an isometric view of a twisted and offset bus bar.

Referring to FIG. 2, vertical bus bar (bus bar) 14 is shown after being formed using the present invention. Prior to being formed by the present invention, the bus bar 14 has a substantially rectangular cross section that is uniform throughout the length of the bus bar 14. Bus bar 14, as shown in FIG. 2, having a flat section 46 and an edge section 48, is formed with a twist, generally indicated at 32, and an offset, generally indicated at 42, using the present invention as described hereinafter. Bus bar 14 has a first end 50 an opposing second end 52, a first section, shown generally at 44, a second section, shown generally at 54, and a third section, shown generally at 56. First, second and third sections 44, 54, 56 are all continuous sections. First section 44 is located in a first plane defined in the x-y plane. Twist 32 is formed around the bus bar longitudinal axis, shown at 1—1, preferably rotated about a centrally located longitudinal axis, in the second section 54 which is in a second plane. Most preferably, the second plane is generally orthogonal to the first plane. The offset 42 positions the third section 56 in a third plane that is generally parallel to the second plane.

Figure 3:
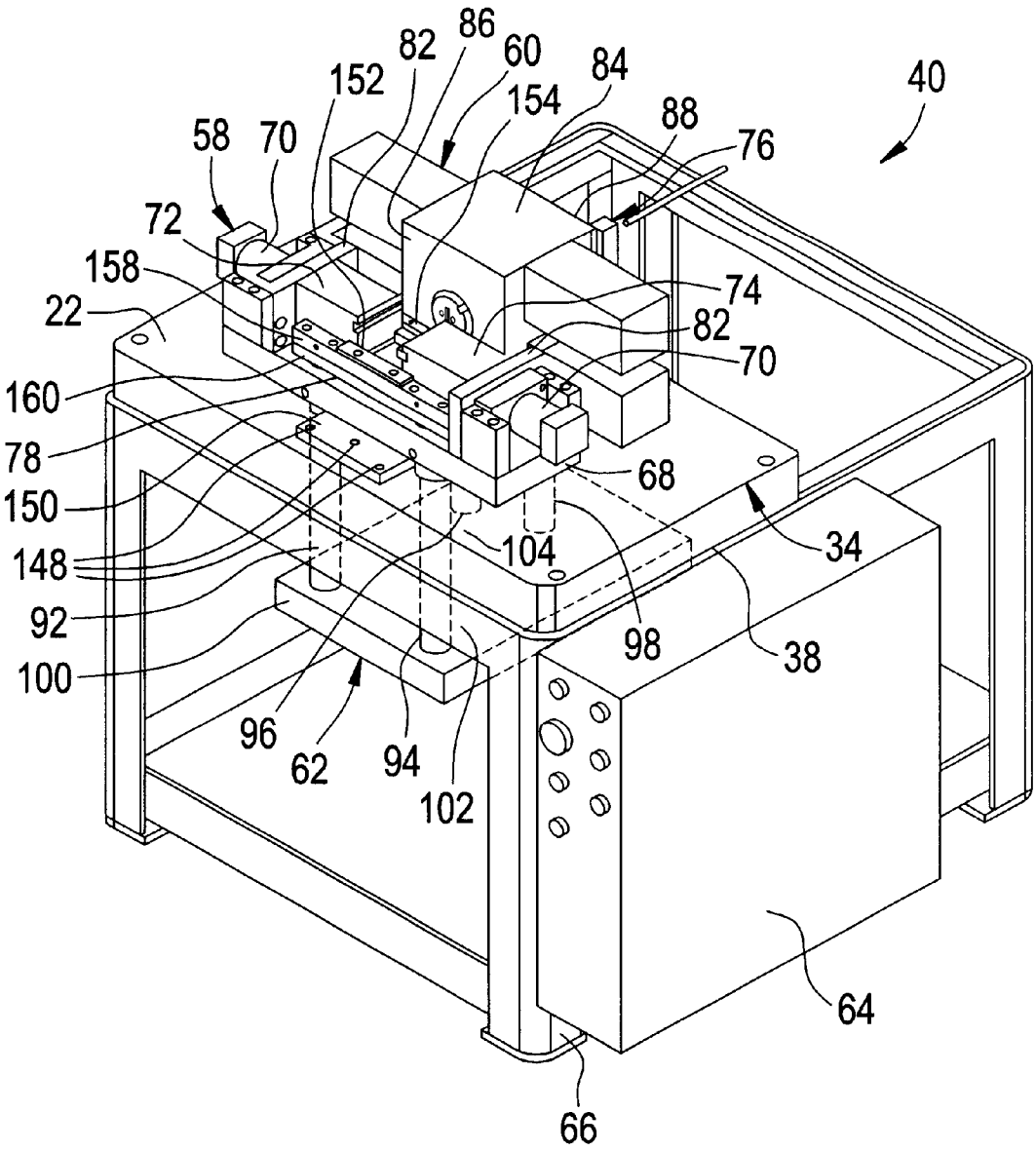
FIG. 3 is an isometric view of a fabrication machine according to the present invention.

Referring to FIG. 3, a fabrication machine (machine) is shown generally at 40 and includes a holding mechanism 58, a twisting mechanism 60, an offset mechanism 62 and a control system 64. The machine 40 includes a frame 66 that provides support for the machine 40 and a base plate, shown generally at 34, having a top surface 22 and a bottom surface 38, where the base plate 34 is attached to frame 66.

Figure 4:
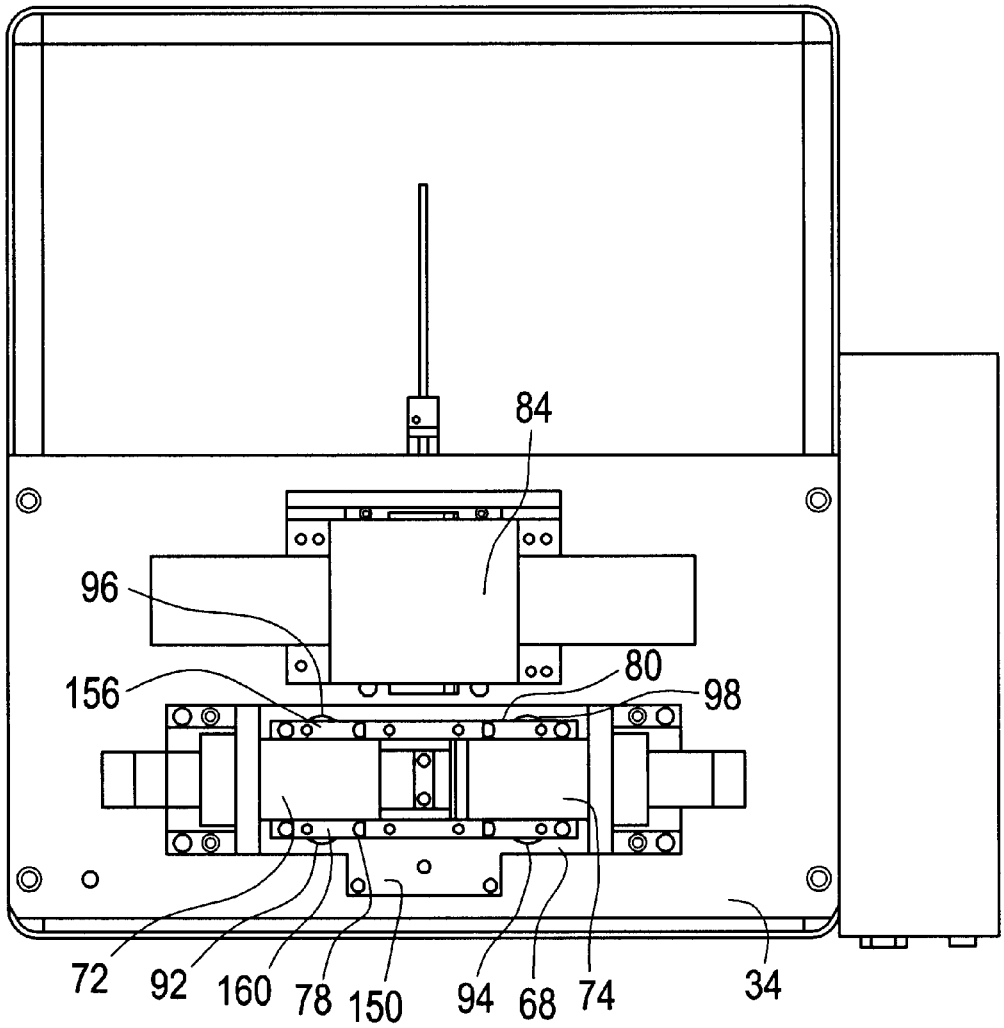
FIG. 4 is a front plan view of the fabrication machine of FIG. 3.

The holding mechanism (retaining device) 58 is mounted to a plate 68 and includes a pair of hydraulic cylinders 70, a gib plate 160, a clamp member 72, a clamp member 74 and a stop member 76. Gib plate 160 has a first side 78 and a second side 80 (FIG. 4). The clamp members 72, 74 are mounted on the plate 68 opposing one another. The pair of hydraulic cylinders 70 is mounted on plate 68 and is operatively connected to the clamp members 72, 74. A pair of cylinder plates 82 is located between the clamp member 72 and respective hydraulic cylinder 70 and the clamp member 74 and respective hydraulic cylinder 70 as shown in FIG. 3. The pair of hydraulic cylinders 70 moves the clamp members 72, 74 inwardly towards and away from each other along a horizontal plane. When moved towards each other, the clamp members 72, 74 secure the bus bar 14 (FIG. 2) being worked on.

The gib plate 160 is fixedly mounted to the plate 68 of the holding mechanism 58. A front gib 158 is positioned on gib plate 160 proximate to first side 78. A rear gib 156 (FIG. 4) is positioned on gib plate 160 proximate to the second side 80. Front and rear guides 152, 154 are mounted to the front gib 158 and the rear gib 156, respectively. The front and rear guides 152, 154 guide the horizontal movement of the clamp members 72, 74 which travel on the plate 68.

The twisting mechanism (retaining device) 60 includes a twisting device, preferably a rotary actuator (twisting device) 84, having a first side 86 and a second side 88. The twisting mechanism 60 is mounted to the base plate 34.

The offset mechanism 62 includes a hydraulic cylinder, shown generally at 90 (FIG. 11), the bottom plate 100, and a first, second third and fourth guide rods 92, 94, 96, 98 (shown in phantom lines). Bottom plate 100 is preferably rectangular in shape. First, second, third and fourth guide rods 92, 94, 96, 98 each include a first end 102 and an opposing second end 104. First, second, third and fourth guide rods 92, 94, 96, 98 are fixedly connected with mechanical fasteners, preferably nuts, at first end 102 to bottom plate 100 of the holding mechanism 58, generally proximate to the comers of bottom plate 100. Opposing second end 104 of first, second third and fourth guide rods 92, 94, 96, 98 are inserted through corresponding apertures (not shown) extending from the bottom surface 38 of the base plate 34 through to the top surface 22 of the base plate 34 through apertures (not shown) within the plate 68 and finally are fixedly connected to gib plate 160.

Figure 5:
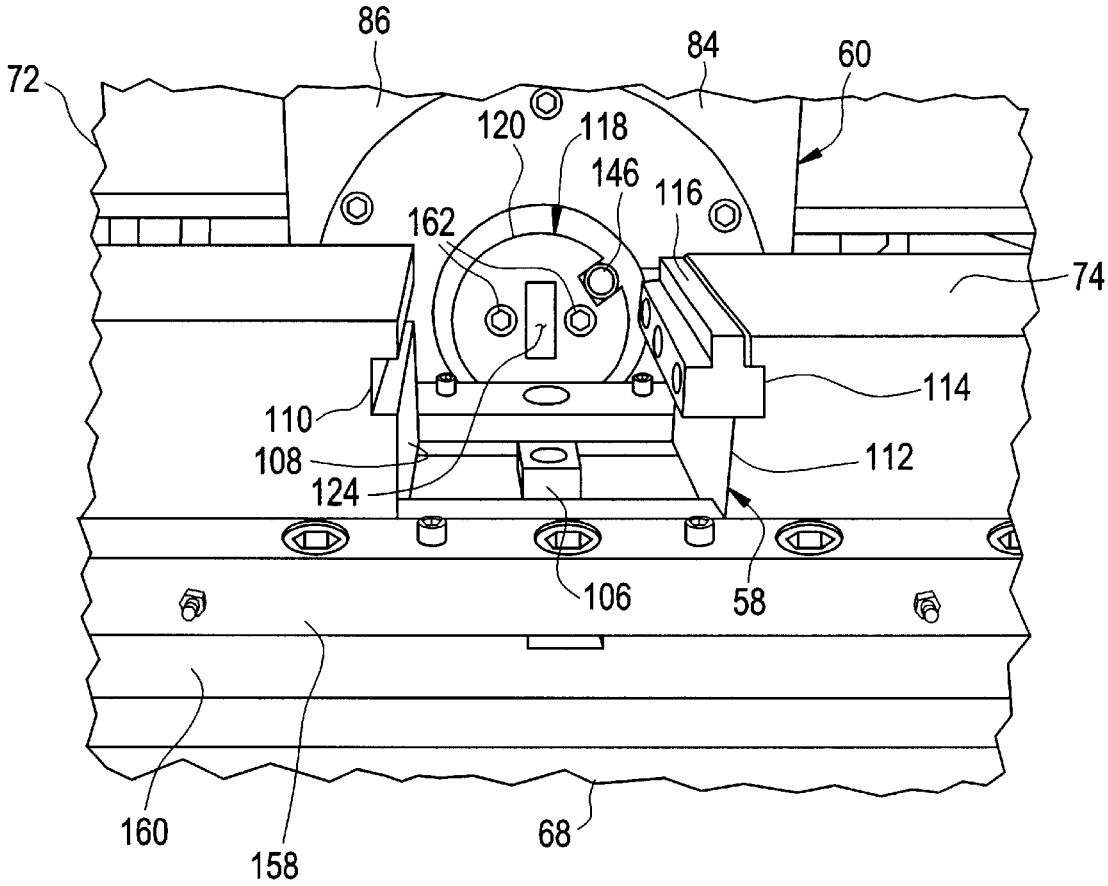
FIG. 5 is an isometric partial view of a holding mechanism of the fabrication machine of FIG. 3.
Figure 6:
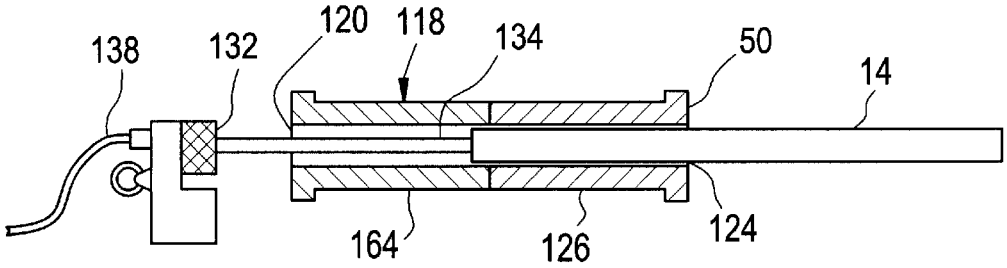
FIG. 6 is a cross section view of a stop member and a sleeve employed with a twisting device of the fabrication machine of FIG. 3.

Referring to FIGS. 5 and 6, the holding mechanism 58 and the twisting mechanism 60 are further detailed.

The holding mechanism 58 includes a clamp stop 106 mounted to the gib plate 160. Clamp stop 106 prevents the untwisted end of the bus bar 14 (FIG. 2) from rotating during the twist operation and also secures the bus bar 14 within the holding mechanism 58 during the offset operation. The clamp member 72 includes a side 108 having an elongated slot 110 formed therein. The clamp member 74 includes a side 112 having an elongated slot 114 formed therein. The holding mechanism 58 also contains a clamp key 116 captively inserted between the elongated slot 110 and the elongated slot 114. The clamp key 116 provides additional securement to the clamping force applied to the bus bar 14 by the clamp members 72, 74 as the offset is formed within the bus bar 14. Clamp key 116 also prevents the bus bar 14 from pulling in an opposite direction from the generally downward force being applied by the offset mechanism 62 when the offset operation is executed.

The twisting mechanism 60 further includes a sleeve, generally shown at 118, inserted into an opening 120, preferably cylindrical, within the rotary actuator 84. Opening 120 extends from the first side 86 (FIG. 3) to the second side 88 (FIG. 3) of rotary actuator 84. Sleeve 118 is positioned inside rotary actuator 84 and locates the bus bar 14 within the fabrication machine 40 (FIG. 3). Sleeve 118 includes a front half 126 and a back half 164. Front half 126 of sleeve 118 is inserted through opening 120 on the first side 86 of rotary actuator 84. Back half 164 of sleeve 118 is inserted through opening 120 on the second side 88 of rotary actuator 84 (FIG. 3).

The front and back halves 126, 164 of sleeve 118 are fastened together preferably using mechanical fasteners 162. The sleeve 118 forms an opening 124. Opening 124 has a rectangular cross section to accommodate the bus bar 14 and extends longitudinally through the rotary actuator 84. It is noted that the cross sectional shape of opening 124 of sleeve 118 can vary based on the cross section of the bus bar inserted therein. The sleeve 118 thus locates the bus bar 14 to be worked on. Preferably, the sleeve 118 is keyed using a key member 122 (FIG. 7) such that the sleeve 118 is interchangeable to accommodate bus bars of various sizes and shapes. The key member 122 extends longitudinally in a slot 166 extending along the exterior of the sleeve 118. A mechanical fastener, preferably a screw 146, holds the key member 122 in slot 166. In this way, the screw 146 can be removed first, then, the key member 122 can be removed and the sleeve 118 interchanged to accept various sized bus bars. The rotary actuator 84 is preferably a dual acting rack and pinion system that rotates the sleeve 118 and the key member 122 about a fixed center as the rack gears are energized.

Figure 8:
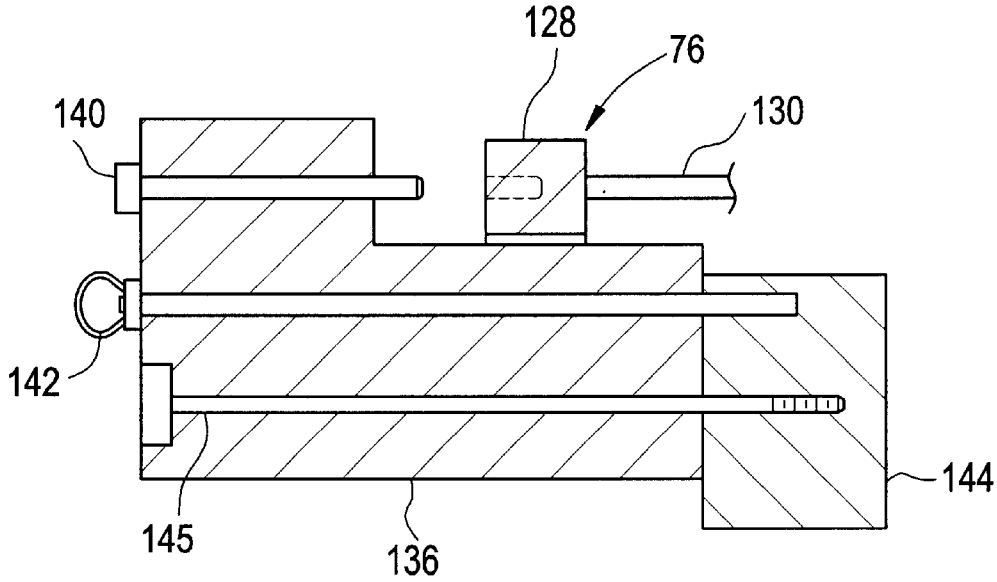
FIG. 8 is a cross sectional view of an arm employed with the stop member of FIG. 6.
Figure 9:
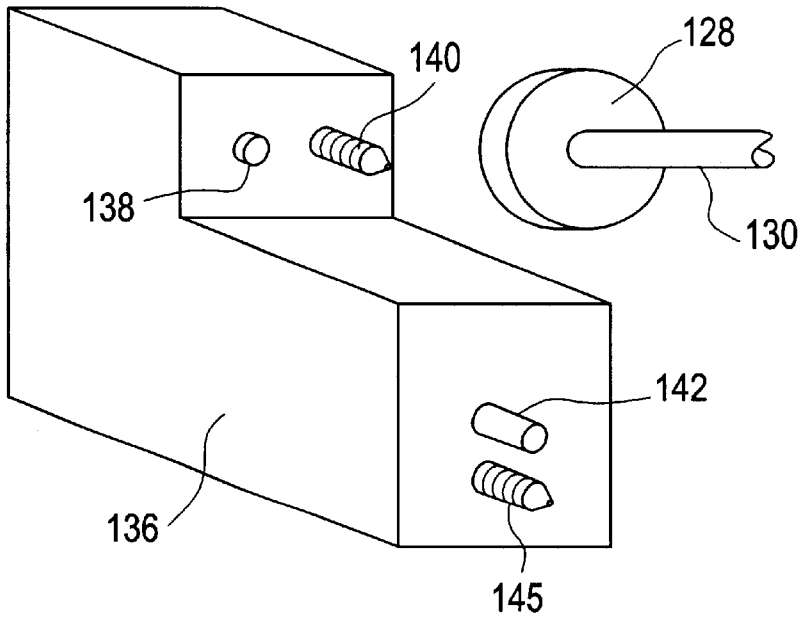
FIG. 9 is an isometric view of the arm of FIG. 8.
Figure 10:
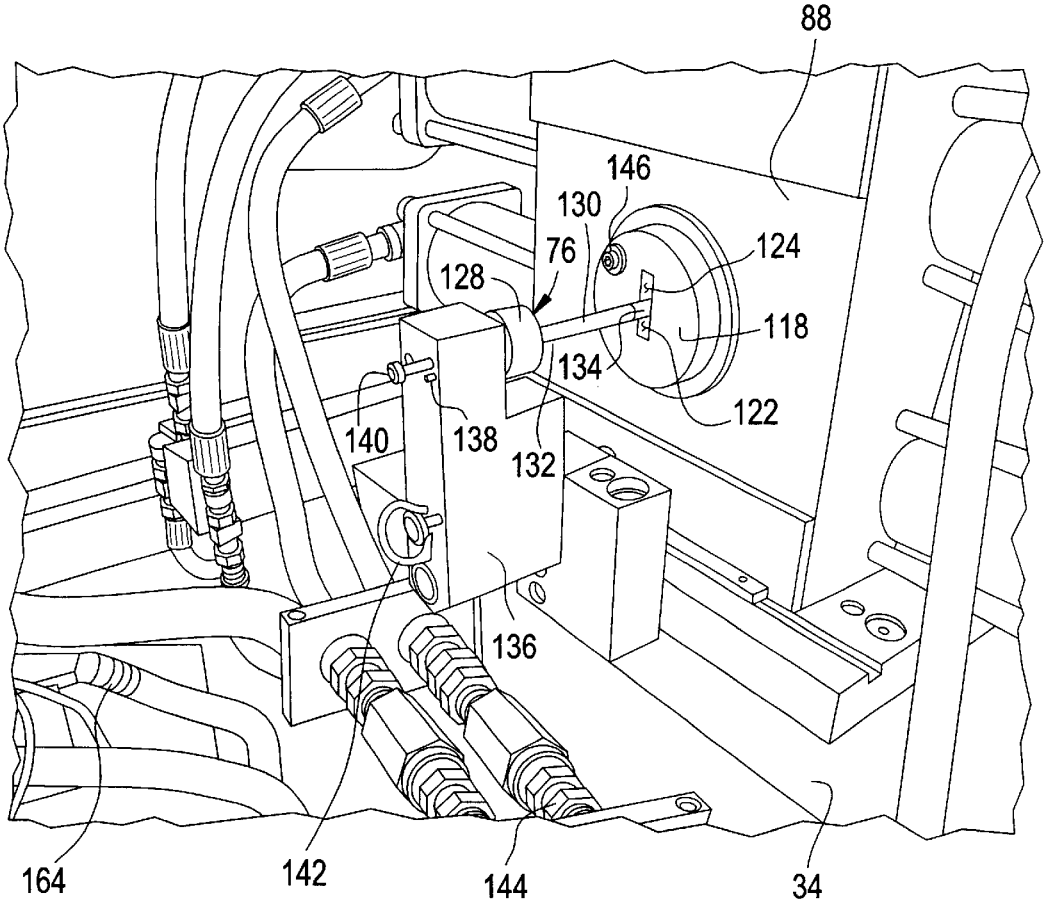
FIG. 10 is an isometric partial view of the stop member and the arm assembled with the fabrication machine of FIG. 3.

Referring to FIGS. 8, 9 and 10, a stop member, shown generally at 76, is shown in detail. FIGS. 8 and 9 show stop member 76 prior to being to being fully inserted into opening 124 (FIG. 5).

Stop member 76 is located at the second side 88 of the rotary actuator 84 and locates the lateral position in the bus bar 14 where the twist will be formed. Stop member 76 includes a stop block 128 connected to an end of a stop rod 130. Stop rod 130 has a first end 132 and an opposing second end 134. First end 132 is fixedly connected to stop block 128. Second end 134 is a free end arranged to provide a fixed barrier for the first end 50 (FIG. 2) of bus bar 14 when inserted into opening 124. The stop rod 130 is fully inserted such that it makes contact with the bus bar 14, thus indicating the bus bar 14 is fully inserted inside the rotary actuator 84 and ready for the twist to be formed. Stop block 128 is mounted to an arm 136 that is pivotally mounted to a support member 144 by a pivot screw 145. Pivot screw 145 extends through arm 136 and into support member 144. During machine operation, the arm 136 is securely mounted to support member 144. Support member 144 is fixedly connected to the base plate 34 of the machine 40 (FIG. 3). Stop block 128 is fastened to arm 136 by a fastener 140. Preferably, fastener 140 is a carriage bolt such that the stop block 128 is tightened until threads end. The arm 136 contains a pressure switch, a mechanical fastener 140, and a pin 142. The pin 142 is preferably a pull pin such that it is pulled in a direction away from arm 136 to release the arm 136 to rotate clockwise about pivot screw 145.

The pressure switch 138 is spring loaded and holds the stop block 128 away from the arm 136 until the bus bar 14 is pressed against the stop block 128. This occurs when the bus bar 14 is inserted into opening 124. When the bus bar 14 is fully inserted into opening 124, it makes contact and applies pressure to second end 134 of stop rod 130. The stop block 128 engages the pressure switch 138 thereby closing the pressure switch 138. The closure of the pressure switch 138 indicates the bus bar 14 is fully inserted and the machine 40 can then operate.

Figure 11:
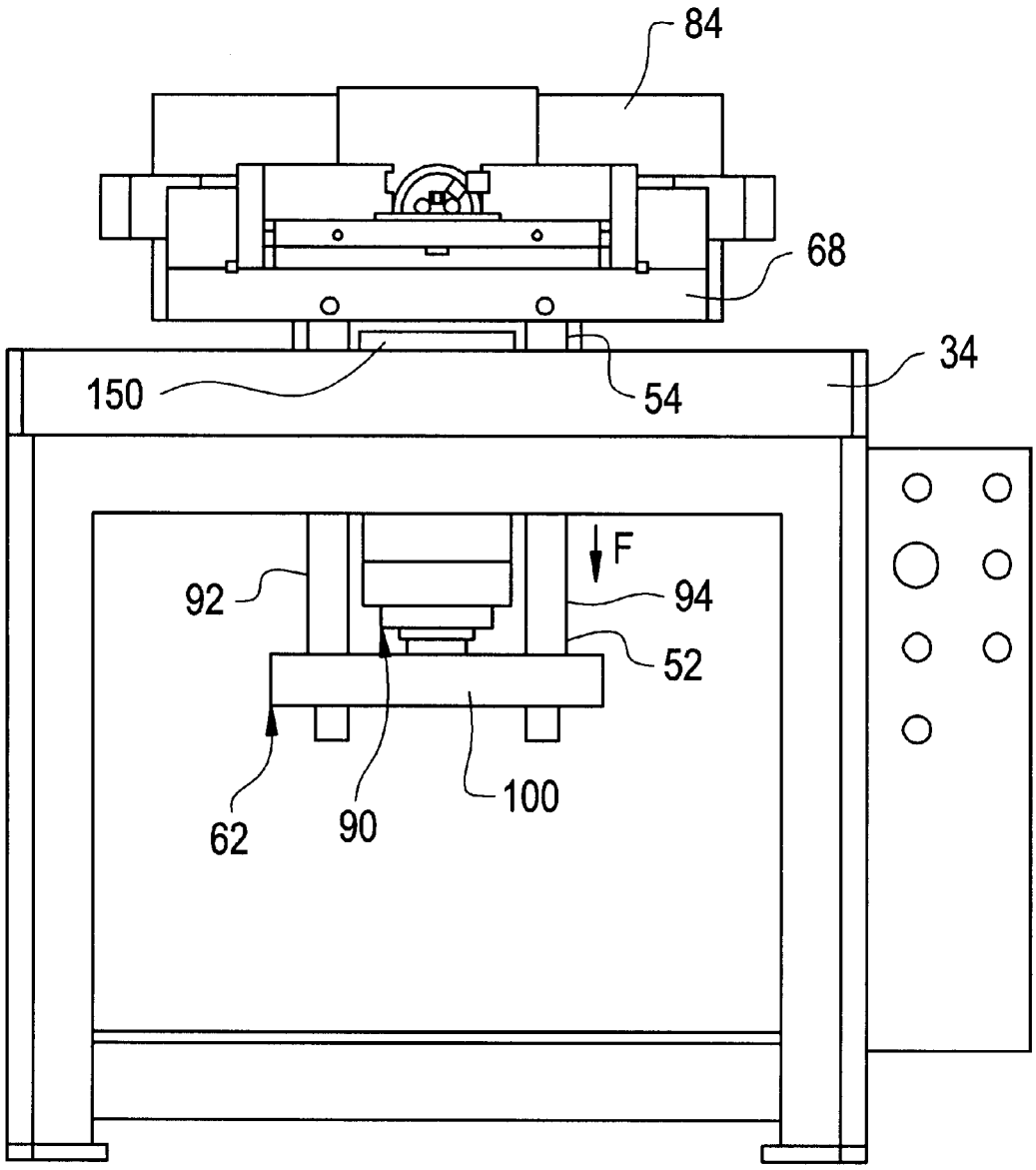
FIG. 11 is an isometric view of an offset mechanism of the fabrication machine of FIG. 3.

Referring to FIG. 11, the offset mechanism 62 will be detailed. FIG. 11 shows the offset mechanism 62 in a "ready" position, that is prior to the offset operation being initiated by the control system 64.

Hydraulic cylinder 90 is connected to bottom plate 100 and operates to raise and lower the bottom plate 100 and the holding mechanism 58, via first, second guide rods 92, 94 and third and fourth guide rods 96, 98 (FIG. 3) during the offset operation. First, second, third and fourth guide rods 92, 94, 96, 98 are preferably generally parallel to each other and positioned to maintain the horizontal level of the bottom plate 100 and the alignment of the bus bar 14 within the rotary actuator 84 as the hydraulic cylinder 90 raises and lowers the plate 68 relative to the base plate 34. It should be noted that the rotary actuator 84 remains stationary throughout the forming operation.

A stop plate 150 of a predetermined thickness is positioned on top surface 22 of base plate 34 and in between first, second, third and fourth guide rods 92, 94, 96, 98. Preferably, the stop plate 150 is secured to the base plate 34 with mechanical fasteners through apertures 148 (FIG. 3). The control system 64 includes a programmable logic controller (not shown) and adjusts the amount of force exerted on the bus bar 14 and the timing sequence of the forming. The controller includes a memory that stores programs created for each type of bus bar 14 to be worked on by the machine 40. The controller also contains start and stop switches for beginning the operation and for emergency stop and off-on switching functions. The control system provides for the operation of the holding mechanism 58, twisting mechanism 60 and offset mechanism 62 within a single machine cycle. A hydraulic power supply (not shown) provides power to the pair of hydraulic cylinders 70 as well as the hydraulic cylinder 90 in the machine 40.

Referring to FIGS. 3, 4, 10 and 11, the operation of the machine 40 to form a twist and offset within a bus bar 14 will now be described.

The offset operation and the twisting operation are completed during one machine cycle as the holding mechanism 58 clamps the bus bar 14. The machine cycle begins when the machine is activated. The holding mechanism 58 closes to retain the bus bar 14. The twisting mechanism 60 then takes place followed by the operation of the offset mechanism 62. The second section 54 of the bus bar 14 is then twisted to the desired degree and the third section 56 is offset to the desired dimension. After completion of the cycle, the holding mechanism 58 releases and the bus bar 14 is removed. The rotary actuator 84 and the offset mechanism 62 return to their start or ready positions so that the next bus bar 14 may be formed within the machine 40. The operations will now be more fully described.

Figure 7:
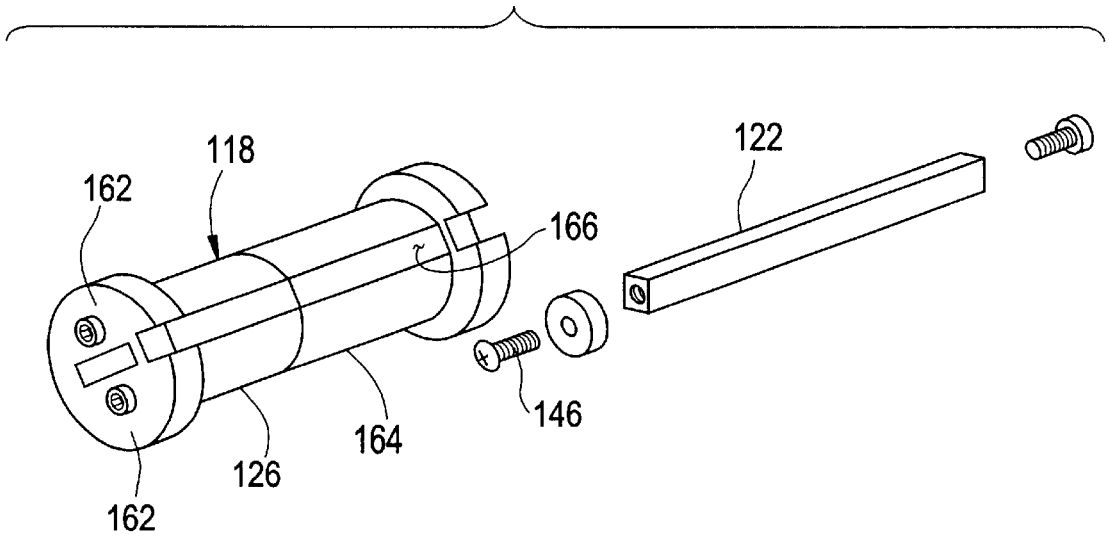
FIG. 7 is an assembly of the sleeve of FIG. 6.

The offset mechanism 62 is positioned within the "ready" position as shown in FIG. 7. The stop plate 150 is positioned and secured on top surface 22 of base plate 34 and in between first, second, third and fourth guide rods 92, 94, 96, 98. Prior to operation of the machine 40, the stop plate 150 does not make contact with the plate 68. Sleeve 118 is selected and keyed with the rotary actuator 84 using the key member 122. The sleeve 118 is selected based on the size of the bus bar to be worked on. Although a keyed sleeve 118 is preferred, any suitable insert may be used consistent with the cross section of the bus bar to be worked on. An appropriate program is selected from the control system 64 for the size and shape of the bus bar 14. Next, the stop member 76 is positioned within the second side 88 of the rotary actuator 84. The length of the stop rod 130 selected determines the lateral location along the bus bar 14 where the twist will be formed.

The first end 50 of bus bar 14 is then inserted into opening 124 of sleeve member 118. Opening 124 of sleeve 118 corresponds to the cross section of the bus bar 14. The first end 50 of bus bar 14 will rest against second end 134 of stop rod 130. The clamp member 72, clamp member 74 and clamp key 116 are securely positioned around the outer surface of the bus bar 14 by activation of the pair of hydraulic cylinders 70.

When the twisting mechanism 60 is activated, the rotary actuator 84 forms a twist 32 in the second section 54 of the bus bar 14. As a result of the twist 32, the third section 56 is rotated preferably ninety degrees such that the third section 56 is substantially perpendicular to the first section 44.

The offset in the bus bar 14 is formed by the offset mechanism 62. When the offset mechanism 62 is activated, the hydraulic cylinder 90 moves the plate 68 vertically downward until the plate 68 makes contact with the stop plate 150. The vertical downward movement of the hydraulic cylinder 90 imparts a force, F, designated by an arrow (FIG. 11), on the plate 68. The application of the downward force, F, translates the third section 56 of the bus bar 14 downward thus forming the offset. The holding mechanism 58 clamps the third section 56 of the bus bar 14 during the offset operation. The depth of the offset formed is determined by the thickness of the stop plate 150 selected. If a different offset is desired, a stop plate 150 with a different thickness can be employed thus either increasing or decreasing the vertical movement of the plate 68.

Within a single machine cycle, the offset and twist operations are completed. The rotary actuator 84 begins rotating the first and second sections 44, 54 of the bus bar 14. The first section 44 rotates by the action of the rotary actuator 84 but is not twisted as it is captively held within key member 122. During the twist operation, the holding mechanism 58 prevents the third section 56 from rotating. However, the second section 54 is rotated and the twist is formed therein.

Figure 12:
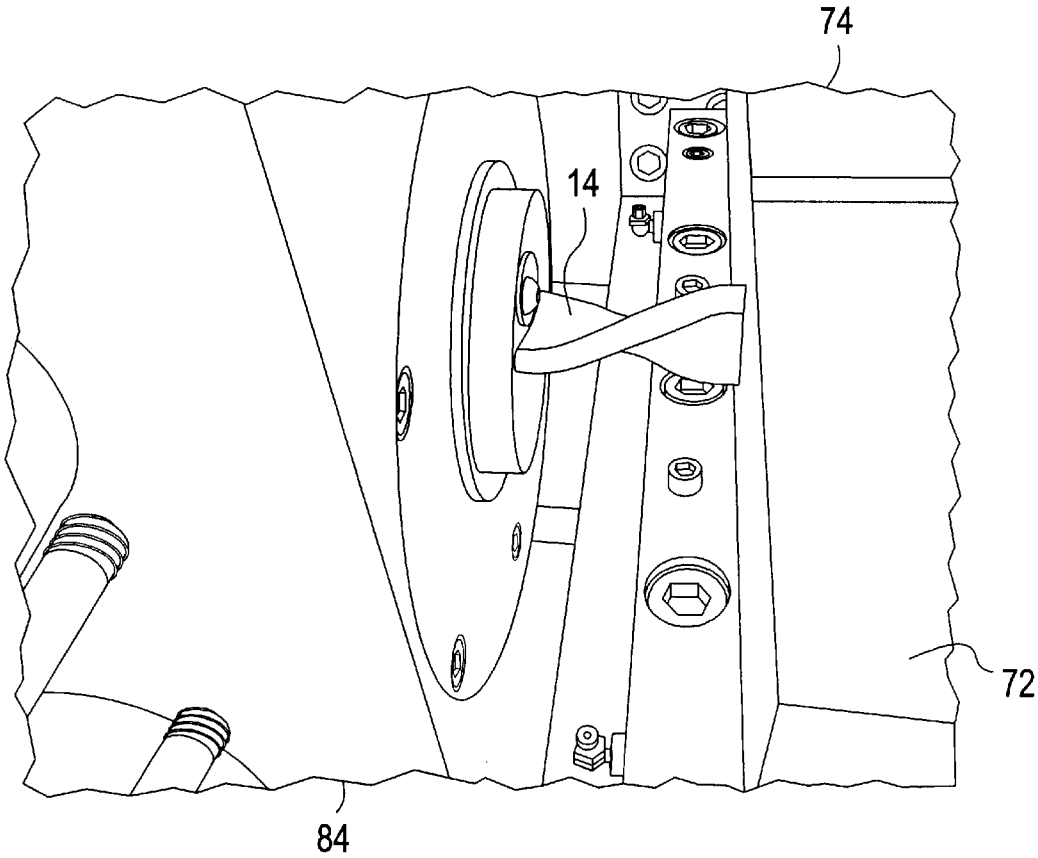
FIG. 12 is a partial isometric view of the twisted bus bar clamped in the fabrication machine of FIG. 3.

Referring to FIG. 12, the bus bar 14 is shown clamped between the clamp member 72 and the clamp member 74 as it is in the process of being twisted. Thus, the bus bar 14 is twisted to the desired degree of rotation and the offset is formed to the desired depth (not shown). After completion of the cycle, the bus bar 14 is released from the clamp member 72, clamp member 74 and clamp key 116 so that it may be removed.

Referring again to FIG. 10, it is further noted and within the scope of this invention that stop rod 130 of stop member 76 can be of varying lengths in order that the lateral location of the twist can be easily adjusted by the machine operator as various bus bars 14 are being formed one after the other. To permit greater efficiency of fabrication time, stop rods 130 of various lengths can be pre-connected to stop blocks 128. In this way, the machine operator can selectively choose the appropriate pre-constructed stop member 76. This is especially helpful when fabricating a variety of bus bars 14 where the location of the twist or twist and offset is required to be in a different lateral location. The replacement of the stop member 76 will now be described. The stop block 128 is loosened from the arm 136 by unscrewing it from fastener 140. Then, the pin 142 is pulled, the arm 138 is released such that it rotates downward about pivot screw 45. Once the arm 138 is cleared from the stop member 76, the stop member 76 can be exchanged. In this way, stop rods of various lengths can be selectively employed with machine 10.

Further, it is also understood by those skilled in the art that any suitable clamping or holding mechanism can be employed to secure the bus bar 14 during the twist and offset operations.

Referring again to FIGS. 2 and 3, machine 40 thus forms a bus bar 14 suitable for use in a motor control center 10 that is selectively formed with a predetermined offset and a degree of twist. Further, the twist and the offset are formed within a single machining cycle. The twist can be adjusted from 0 to 180 degrees. It is further noted that fabrication machine 40 can selectively perform the twist and offset operations on the bus bar 14 as described above, or alternatively, can perform only the twist operation on the bus bar 14.

By twisting and offsetting the bus bar 14 in a single machine operation as described hereinabove, the machine 40 reduces the time required to fabricate the twist and offset within the bus bar 14. The offset permits the reduction of the overall number of bolted connections required within the bus bar 14 while maintaining adequate space between adjacent bus bars 14 within a motor control center 10 thus preventing short circuits between the bus bars 14 and the cabinet 12. As a result, the space previously required for such bolted connections is no longer required. The offset within the bus bar 14 is therefore, especially advantageous within motor control centers where available space to house bus bars and electrical components is limited. Finally, since the machine 40 performs the twist and offset operations in a single machine cycle, no heating of the bus bar 14 is required during the forming operation. Thus, by eliminating the second operation of forming the offset as in the prior art, the work hardening of the bus bars 14 associated with this second operation is also eliminated.

While the invention has been described with reference to a preferred embodiment, it will be understood by those skilled in the art that various changes may be made and equivalents may be substituted for elements thereof without departing from the essential scope thereof. Therefore, it is intended that the invention not be limited to a particular embodiment disclosed as the best mode contemplated for carrying out this invention, but that the invention will include all embodiments falling within the scope of the appended claims.

What is claimed is:

1. A fabrication machine for shaping a bus bar comprising:

a first retaining device arranged to secure a first section of the bus bar in a first plane;

a second retaining device arranged to secure a third section of the bus bar, a second section of the bus bar positioned between said first and second retaining devices, said first, second and third sections having a longitudinal axis extending therethrough;

a twisting device connected to said second retaining device, said twisting device rotates said second retaining device to twist the second section of the bus bar about said longitudinal axis of the bus bar positioning the second section of the bus bar in a second plane, said longitudinal axis lies in the first and second planes; and an offset mechanism connected to said first retaining device, said offset mechanism arranged to offset the third section of the bus bar in a third plane, the third plane generally parallel to the second plane.

2. The fabrication machine of claim 1 wherein said second retaining device arranged to twist the bus bar about the longitudinal axis of the bus bar positioning the bus bar in the second plane, the second plane generally orthogonal to the first plane.

3. The fabrication machine of claim 1 wherein said twisting device includes an actuating member having an opening flanked by a first side and a second side, said opening configured to receive the second section of the bus bar.

4. The fabrication machine of claim 3 further comprising:

a base plate having a top surface and a bottom surface;

wherein said first and second retaining devices are mounted to said top surface of said base plate.

5. The fabrication machine of claim 3 further comprising:

a sleeve positioned within said opening of said actuating member; and a stop member located proximate to said second side of said actuating member, said stop member for locating the lateral position in the bus bar where the twist is formed by positioning the second section of the bus bar within said second retaining device.

6. The fabrication machine of claim 5 wherein said sleeve includes an opening, said opening and the bus bar having the same cross sectional shape.

7. The fabrication machine of claim 6 wherein said opening has a rectangular cross section.

8. The fabrication machine of claim 4 wherein said first retaining device includes:

a first clamp member having a first side; and a second clamp member having a first side, said first side of said second clamp member positioned in generally opposing relation to said first side of said first clamp member;

wherein said first and second clamp members are configured for translational movement to engage and secure the bus bar there between.

9. The fabrication machine of claim 8 further comprising:

a plate, said first and second clamp members mounted to said plate for translational movement on said plate; and a first hydraulic cylinder mounted to said plate and operatively connected to said first clamp member, said first hydraulic cylinder arranged to freely move said first clamp member toward and away from said second clamp member.

10. The fabrication machine of claim 9 further comprising a second hydraulic cylinder mounted to said plate and operatively connected to said second clamp member, said second hydraulic cylinder arranged to freely move said second clamp member toward and away from said first clamp member.

11. The fabrication machine of claim 9 further comprising:

a gib plate having a first side and a second side;

a front gib fixedly attached to said first side of said gib plate;

a rear gib fixedly attached to said second side of said gib plate; and a front guide and a rear guide, said front guide positioned on said front gib, said rear guide positioned on said rear gib, said front and rear guides guide said first and second clamp members on said plate.

12. The fabrication machine of claim 10 wherein said first side of said first clamp member having a first slot formed therein and said first side of said second clamp member having a second slot formed therein.

13. The fabrication machine of claim 12 further comprising a clamp key captively inserted between said first slot and said second slot.

14. The fabrication machine of claim 1 wherein said offset mechanism includes:

a bottom plate;

a first guide rod having a first end and a second end, said first end connected to said bottom plate and said second end connected to said plate; and a hydraulic cylinder mounted to said bottom plate and arranged to lower said bottom plate causing said second retaining device to impart an offset to the bus bar.

15. The fabrication machine of claim 12 further comprising a stop plate located between said base plate and said plate, wherein said stop plate is of a predetermined thickness to determine the degree of offset imparted to the bus bar.

16. The fabrication machine of claim 5 wherein said stop member includes:

a support member mounted to said base plate;

an arm pivotally mounted to said support member;

a stop block fastened to said arm; and a stop rod connected to said stop block, said stop rod of a predetermined length and inserted into said opening of said sleeve for contact with the bus bar when the bus bar is fully inserted into said opening of said sleeve.

17. The fabrication machine of claim 16 wherein said stop block is removably fastened to said arm.

18. The fabrication machine of claim 17 wherein said arm further includes a pressure switch adjacent to said stop block;

wherein said pressure switch engages said stop block when the bus bar engages said stop rod during insertion of the bus bar within said second retaining device indicating the bus bar is fully inserted within said second retaining device.

19. The fabrication machine of claim 14 further comprising:

a second guide rod having a first end and a second end, said first end connected to said bottom plate and said second end connected to said base plate;

a third guide rod having a first end and a second end, said first end connected to said bottom plate and said second end connected to said base plate; and a fourth guide rod having a first end and a second end, said first end connected to said bottom plate and said second end connected to said base plate.

20. A method for forming a twist and offset in a bus bar comprising:

securing a first section of a bus bar in a first retaining device;

securing a second section and a third section of the bus bar between the first retaining device and a second retaining device;

rotating said second retaining device relative to said first retaining device to form a twist in the second section of the bus bar; and translating said first retaining device relative to said second retaining device to form an offset in the third section of the bus bar.

21. The method of claim 20 wherein said step of securing the bus bar between said first retaining device and said second retaining device includes inserting the bus bar between an opening in a sleeve within said second retaining device.

22. The method of claim 20 further comprising:

releasing the bus bar from said first retaining device and said second retaining device.

* * * * *